US006819163B1

(12) United States Patent
Gregoire, Jr.

(10) Patent No.: US 6,819,163 B1
(45) Date of Patent: Nov. 16, 2004

(54) SWITCHED CAPACITOR VOLTAGE REFERENCE CIRCUITS USING TRANSCONDUCTANCE CIRCUIT TO GENERATE REFERENCE VOLTAGE

(75) Inventor: Bernard Robert Gregoire, Jr., Bozeman, MT (US)

(73) Assignee: AMI Semiconductor, Inc., Pocatello, ID (US)

( * ) Notice: Subject to any disclaimer, the term of this patent is extended or adjusted under 35 U.S.C. 154(b) by 18 days.

(21) Appl. No.: 10/401,082

(22) Filed: Mar. 27, 2003

(51) Int. Cl.[7] ..... G05F 1/10
(52) U.S. Cl. ..... 327/536; 327/539
(58) Field of Search ..... 327/536, 538, 327/539

(56) References Cited

U.S. PATENT DOCUMENTS

| | | | | |
|---|---|---|---|---|
| 4,375,595 A | | 3/1983 | Ulmer et al. | 307/297 |
| 5,059,820 A | | 10/1991 | Westwick | 307/296.6 |
| 5,352,972 A | | 10/1994 | Pernici et al. | 323/313 |
| 5,563,504 A | | 10/1996 | Gilbert et al. | 323/316 |
| 5,831,845 A | * | 11/1998 | Zhou et al. | 363/60 |
| 5,867,012 A | | 2/1999 | Tuthill | 323/313 |
| 6,107,862 A | * | 8/2000 | Mukainakano et al. | 327/536 |
| 6,169,444 B1 | | 1/2001 | Thurber, Jr. | 327/536 |
| 6,323,801 B1 | | 11/2001 | McCartney et al. | 341/172 |
| 6,445,305 B2 | | 9/2002 | Andersson et al. | 340/636 |
| 6,480,436 B2 | * | 11/2002 | Confalonieri et al. | 365/226 |
| 6,522,558 B2 | * | 2/2003 | Henry | 363/60 |

* cited by examiner

*Primary Examiner*—Dinh T. Le
(74) *Attorney, Agent, or Firm*—Workman Nydegger

(57) ABSTRACT

A switched capacitor voltage reference circuit that has a transconductance circuit that receives the output of the amplifier, and then outputs a current that depends on its input voltage. This may be accomplished using a charge pump that is controlled by the amplifier output. The transconductance circuit provides a reference voltage at the output terminal of the switched capacitor generation circuit. A capacitor capacitively couples the output terminal of the switched capacitor circuit to the inverting terminal of the amplifier during the generation phase. By adjusting the capacitances of the various capacitors, the level and temperature dependence of the generated reference voltage may be controlled. Also, the charge pump often allows for reference voltages that are greater than the supply voltage.

40 Claims, 8 Drawing Sheets

SWITCHED CAPACITOR VOLTAGE REFERENCE CIRCUITS USING TRANSCONDUCTANCE CIRCUIT TO GENERATE REFERENCE VOLTAGE

BACKGROUND OF THE INVENTION

1. The Field of the Invention

The present invention relates to analog integrated circuit design, and more particularly, to voltage reference circuits that use switched capacitor configurations to provide desired temperature dependencies in the output voltage, and that uses transconductance circuits to aid in generating the reference voltage.

2. Background and Related Art

Analog circuit technology has revolutionized the way people work and play and has contributed enormously to the advancement of humankind. In many analog circuit designs, it is often desirable to have access to a voltage source other than the voltages that are supplied to the circuit as a whole (often termed Vdd and Vss). Often, the voltage desired is even higher than the highest supply voltage. To generate such high voltages, charge pumps are often used.

FIG. 7 illustrates a conventional voltage generation circuit 700 in accordance with the prior art. The voltage generation circuit 700 is configured to supply a relatively high voltage Vout on the output terminal 701. The voltage generation circuit 700 includes an amplifier 702 having an inverting input terminal 703, a non-inverting input terminal 704, and an output terminal 705. A reference voltage source 706, which supplies a voltage Vref, is coupled to the non-inverting input terminal 704 of the amplifier 702. The inverting input terminal 703 of the amplifier 702 is coupled to an intermediate node in a voltage divider comprising two resisters 707 and 708 having respective resistances R1 and R2. The output terminal 705 of the amplifier 702 is coupled to a control circuit 708 that controls a charge pump 709. The charge pump 709 provides charge on the output terminal 701 of the voltage regulation circuit 700 so as to generate the output voltage Vout.

During operation, when the output voltage Vout exceeds Vref times (R1+R2)/R1, the voltage at the inverting terminal 703 of the amplifier 702 is more than the voltage at the non-inverting terminal 704 of the amplifier 702. Accordingly, the amplifier 702 generates a low voltage at the output terminal 705, which causes the control circuit 708 to cause the charge pump 709 to generate less charge. Conversely, when the output voltage Vout is less than Vref times (R1+R2)/R1, the voltage at the inverting terminal 703 of the amplifier 702 is less than the voltage at the non-inverting terminal 704 of the amplifier 702. Accordingly, the amplifier 702 generates a high voltage at the output terminal 705, which causes the control circuit 708 to cause the charge pump 709 to generate more charge. Accordingly, the voltage at the output terminal 701 of the voltage regulator circuit tends to stabilize at Vref times (R1+R2)/R1.

The voltage regulator circuit 700 requires a reference voltage source 706 which can involve extensive circuitry. Furthermore, the reference voltage Vref, the amplifier 702, the control circuit 708 and the charge pump 709 may have temperature dependencies that are often not desired. Accordingly, what would be advantageous are circuits that allow for the generation of a voltage having particular desired temperature dependences.

FIG. 8 illustrates a switched capacitor voltage reference circuit 800 that allows for better control and predictability over desired temperature dependencies. The desired temperature dependences are obtained by operating the circuit in two phases or time periods and switching capacitor configurations for each time period. During the first time period also referred to as the reset phase, clock signal CLK1 is high (and the signal CLK2 is low) indicating that the switches designated by CLK1 are closed (and the switches designated by CLK2 are open). Note that the switch configuration of FIG. 8 represents the switch configuration during the reset phase. On the other hand, during the second time period also referred to herein as the generation phase, clock signal CLK2 is high (and the signal CLK1 is low) indicating that the switches designed by CLK2 are closed (and the switches designated by CLK1 are open), which is the opposite switch configuration as shown in FIG. 8. The clock signals CLK1 and CLK2 for both the reset and generation phases are illustrated as curves 808 and 809, respectively.

During the reset phase, current from current source 801 (having a magnitude that is "n" times the magnitude of current from the current source 802) is passed through the base-emitter region of the bipolar transistor 805. During the generation phase, current from the current source 802 is passed through the base-emitter region of the bipolar transistor 805. During the reset phase, the emitter terminal of bipolar transistor 805 is coupled to the left terminals of both capacitors 803 and 804. During the generation phase, the emitter terminal of bipolar transistor 805 is still coupled to the left terminal of capacitor 803. However, the left terminal of the capacitor 804 is coupled to Vss during the generation phase. The right terminals of the capacitors 803 and 804 are coupled together and to the inverting terminal of amplifier 806. The non-inverting terminal of the amplifier 806 is coupled to Vss. During the reset phase, the output terminal of the amplifier 806 is coupled back to the inverting terminal of the amplifier 806 thereby rendering the amplifier 806 in its unity gain configuration to define a first feedback loop. A capacitor 807 is also coupled between the output terminal of the amplifier 806 and its inverting input terminal thereby defining a second feedback loop.

If the generation and reset phases do not overlap, the output voltage Vout will generally be defined by the following Equation 1:

$$Vout = \frac{C2}{C3}\left(Vbe1 + \frac{C1}{C2}Ut * \ln(n)\right) \tag{1}$$

where:

C1 is the capacitance of capacitor 803;

C2 is the capacitance of capacitor 804;

C3 is the capacitance of capacitor 807;

Vbe1 is the base-emitter voltage of bipolar transistor 805 during the reset phase;

Ut is the thermal voltage; and n is the ratio of the magnitude of the current supplied by current supply 801 to the magnitude of the current supplied by current supply 802.

The terms Ut*ln(n) and Vbe1 have opposite temperature dependencies (i.e., one increases with increasing temperature, and the other decreases with increasing temperature). Accordingly, by designing the size of capacitors 803 and 804 for an appropriate ratio of C1 to C2, a predictable temperature dependency of Vout may be obtained. The magnitude of the output voltage Vout may be obtained by designing the size of capacitor 804 and 807 for an appropriate ratio of C2 to C3.

Accordingly, the switched capacitor voltage reference circuit 800 provides a significant advancement in the art by allowing a reference voltage to be generated that has predictable temperature dependencies. Similar switched capacitor voltage regulator circuits have been described in which currents of different magnitudes are multiplexed through multiple bipolar transistors. The output voltage generated by such switched capacitor voltage regulator circuits are, however, limited. For example, the output voltage cannot exceed the supply voltage Vdd, and depends on the output range of the amplifier 806. Furthermore, the output voltage of such switched capacitor voltage regulator circuits only generate the desired voltage during the generation phase, but not during the reset phase. Accordingly, circuits that use the reference voltage must take into account the transient nature of the reference voltage.

What would therefore be advantageous is a circuit that supplies a reference voltage that not only has a predictable temperature dependency, but also is not limited to the supply voltage of the circuit. It would further be advantageous if that circuit provided a reference voltage that was present at all times whether during the generation phase or during the reset phase.

BRIEF SUMMARY OF THE INVENTION

The foregoing problems with the prior state of the art are overcome by the principles of the present invention, which are directed towards a switched capacitor voltage reference circuit. The switched capacitor voltage reference circuit operates in a reset phase and a generation phase. The switched capacitor voltage reference circuit generates a reference voltage that is relatively predictable with temperature variation, and which is not limited to the supply voltage, and which does not require separate circuitry for generating another reference voltage.

The switched capacitor voltage reference circuit includes an amplifier that has its output terminal coupled directly or indirectly (e.g., through a non-return to zero circuit) to its inverting input terminal during the reset phase, but not during the generation phase. The non-inverting input terminal of the amplifier may be coupled to a substantially fixed voltage source. A charge injection reduction circuit may be coupled to the non-inverting input terminal of the amplifier so as to reduce charge injection within the amplifier.

A first and second capacitor each has one terminal coupled to the inverting input terminal of the amplifier. A PN junction (such as the base-emitter terminal of a bipolar transistor) has a positive (or negative) terminal that is coupled to a second terminal of the first capacitor. The other terminal of the PN junction is coupled to a substantially fixed voltage source. The second terminal of the second capacitor is configured to be capacitively coupled to the positive (or the negative) terminal of the PN junction during the reset phase and to a negative (or a positive) terminal of the PN junction during the generation phase.

Two current sources providing different current magnitudes are multiplexed through the PN junction, with the larger current supplied through the PN junction during the reset phase, and with the lesser current supplied through the PN junction during the generation phase.

Unlike conventional switched capacitor voltage reference circuits, the switched capacitor voltage reference circuit in accordance with the principles of the present invention includes a transconductance circuit that receives the output of the amplifier, and then generates a current based on any voltage variations at its input. Once example of such a transconductance circuit is a charge pump that is controlled by the amplifier output. The transconductance circuit provides a current at the output terminal of the switched capacitor generation circuit, which with the presence of a load capacitor, causes a stable output voltage to be applied also at the output terminal. The average current supplied by the transconductance circuit would be equal to the load current. A third capacitor capacitively couples the output terminal of the switched capacitor voltage reference circuit to the inverting terminal of the amplifier during the generation phase.

By adjusting or properly designing the capacitances of the first, second, and third capacitors, the level and temperature dependence of the generated reference voltage may be controlled. Also, the switched capacitor generation circuit allows for reference voltages that are greater than the supply voltage if the transconductance circuit were a voltage-controlled charge pump. Furthermore, the reference voltage is supplied during both the generation and reset phases. Accordingly, the principles of the present invention provide a significant advancement in the state of the art.

Additional features and advantages of the invention will be set forth in the description that follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The principles of the present invention are directed towards a switched capacitor voltage reference circuit that has a transconductance circuit that receives the output of the amplifier, and then generates current changes that are roughly proportional to the voltage changes at the input of the transconductance circuit. This may be accomplished using a charge pump that is controlled by the amplifier output. The transconductance circuit provides a current at the output terminal of the switched capacitor voltage reference circuit that, combined with a load capacitor, generates a stable reference voltage also at the output terminal. By adjusting the capacitances of the various capacitors, the level and temperature dependence of the generated reference voltage may be controlled. Also, if a voltage controlled charge pump is used as the transconductance circuit, the generated reference voltage may even be greater than the supply voltage.

In this description and in the claims, one node in a circuit is "coupled" to another node in the circuit if charge carriers freely flow (even through some devices and/or with some resistance) between the two nodes during normal operation of the circuit. Furthermore, if a voltage change at one node results in a substantially the same voltage change at another node, the two nodes are "coupled" as the term is to be used in this description and in the claims. One node in a circuit is "capacitively coupled" to another node in the circuit if there are one or more capacitors that intervene between the two nodes. One node in a circuit is "at least capacitively coupled" to another node if the two nodes are either coupled together as just defined, or are capacitive coupled together as just defined.

A "current" is defined as the average amount of charge flow during a particular clock cycle, whether or not the charge flow is uniform over that particular clock cycle. For example, a charge pump generates a large amount of charge transferred during a short amount of time, which may be a much shorter time than the clock cycle in general.

A "substantially fixed voltage source" is defined as a voltage source that generates a relatively stable voltage during the reset phase, and a relatively stable voltage during the generation phase, without the values necessarily being the same in both the reset and generation phases.

Figure 1:
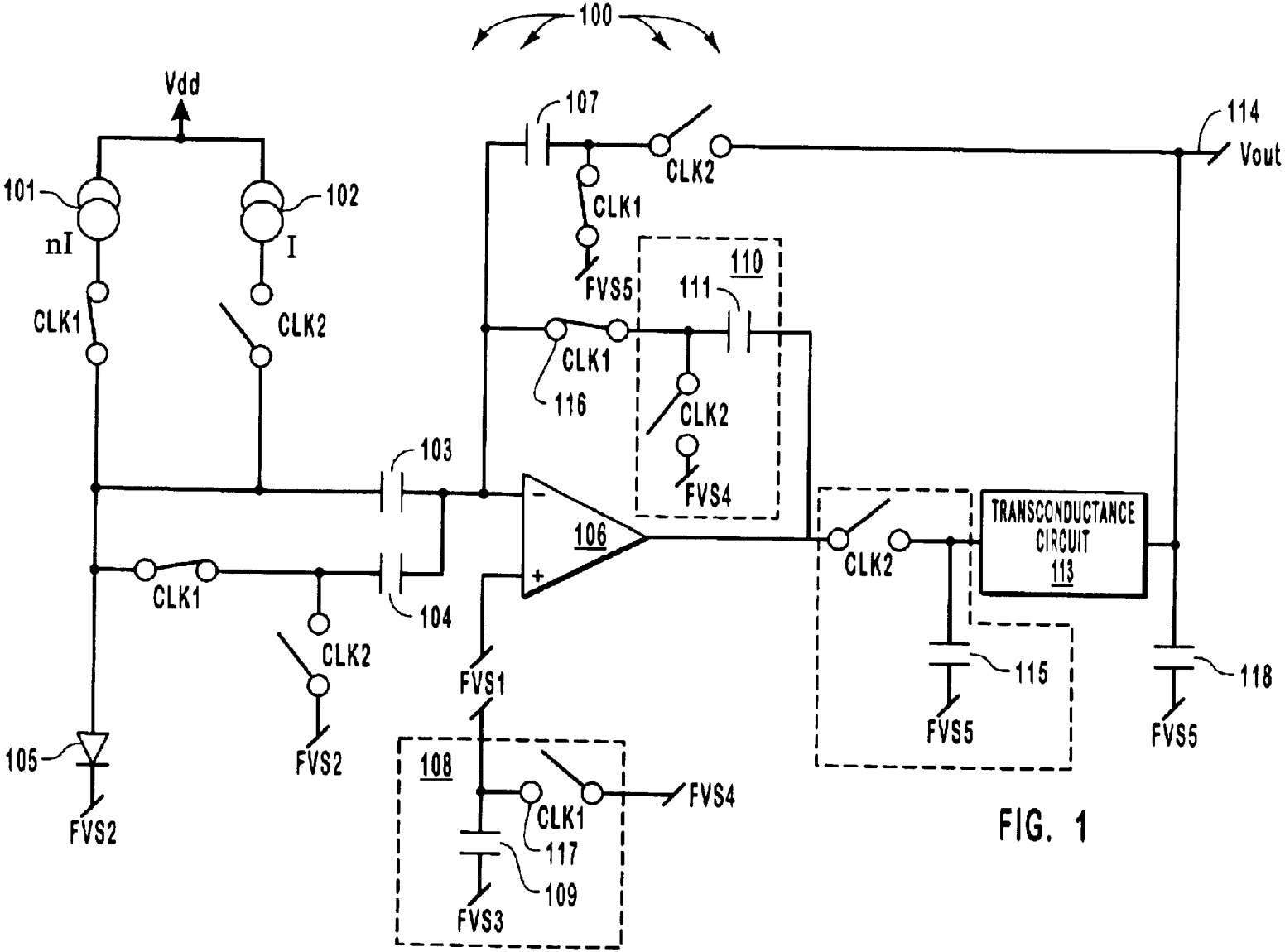
FIG. 1 illustrates a single PN junction switched capacitor voltage reference circuit in accordance with a first embodiment of the present invention in which the PN junction is tied to a low voltage source.
Figure 8:
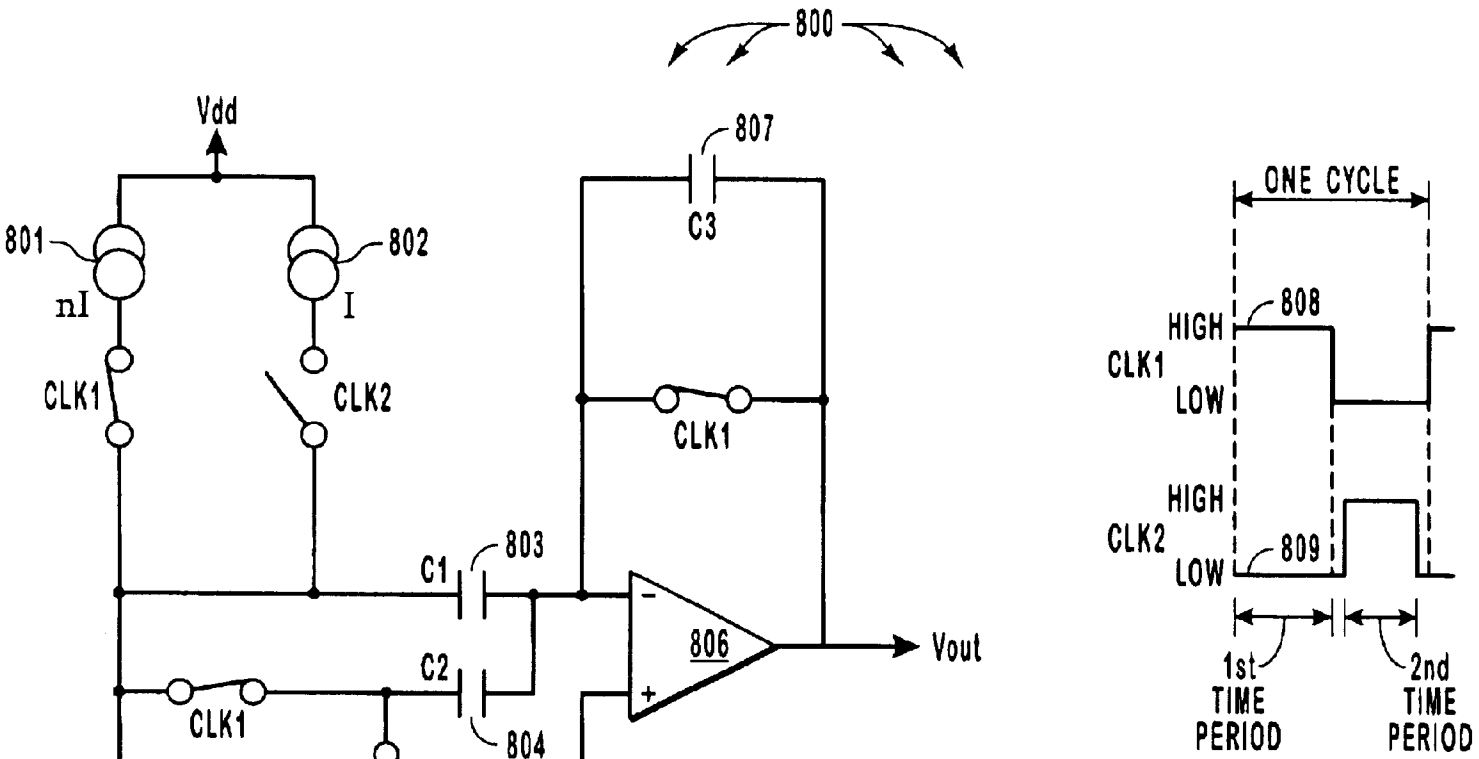
FIG. 8 (PRIOR ART)
FIG. 8 illustrates a switched capacitor voltage regulator circuit in accordance with the prior art.

FIG. 1 illustrates a switched capacitor voltage reference circuit 100 in accordance with an embodiment of the present invention in which two current sources 101 and 102 are multiplexed through a single PN junction 105. The switched capacitor voltage reference circuit operates on a cycle that includes reset phase and a generate phase. The same signals (i.e., signals 808 and 809) used to drive the switching configuration of FIG. 8 may also be used to drive the switching configuration of FIG. 1 and all subsequently described embodiments. In particular, when clock signal CLK1 (signal 808) is high, switches designated by CLK1 are closed, and are otherwise open. Similarly, when clock signal CLK2 (signal 809) is high, switches designated by CLK 2 are closed, and are otherwise open. In all of the drawings, switches designated by CLK1 are closed while switches designed by CLK2 are open, thereby illustrating the reset phase. In the generation phase, all switches illustrated as open would be closed, and vice versa.

In this description, for purposes of clarity, two clock signals CLK1 and CLK2 are used to describe the principles of the present invention. However, various modifications to such a timing structure will be obvious to those of ordinary skill in the art after having reviewed this description. For example, switch 116 may be opened slightly before other switches that are controlled by signal CLK1.

The switched capacitor voltage reference circuit 100 includes an amplifier 106 having an inverting input terminal and a non-inverting input terminal and at least one output terminal. The output terminal of the amplifier 106 is configured to be at least capacitively coupled to the inverting terminal of the amplifier 106 during the reset phase. Accordingly, the amplifier 106 is in the unity gain configuration during the reset phase.

An optional non-return to zero circuit 110 may be provided in this feedback path. The non-return to zero circuit 110 includes a capacitor 111. The right terminal of the capacitor 111 is coupled to the output terminal of the amplifier 106. The left terminal of the capacitor 111 is configured to be coupled to the inverting input terminal of the amplifier 106 during the reset phase and to a substantially fixed voltage source FSV1 during the generation phase. This can be advantageous because, with the presence of the non-return to zero circuit 110, the amplifier 106 does not have to slew from its reset value to its normal output voltage that would be present at the end of the generation phase. Instead, amplifiers with slower slew rates may be used with the non-return to zero circuit 110. If the non-return to zero circuit 110 is present, then the output terminal of the amplifier 106 is capacitively coupled to the inverting input terminal of the amplifier 106 via capacitor 111 during the reset phase. Otherwise, if the non-return to zero circuit 110 is not present, then the output terminal of the amplifier 106 is instead coupled to the inverting input terminal without any intervening capacitors during the reset phase.

The non-inverting input terminal of the amplifier 106 may also be coupled to the substantially fixed voltage source FVS1. Optionally, a charge injection reduction circuit 108 may generate the substantially fixed voltage source FVS1. The charge injection reduction circuit 108 includes a capacitor 109 capacitively coupling the non-inverting input terminal of the amplifier 106 to a third substantially fixed voltage source FVS3. The charge injection reduction circuit 108 is configured to apply a substantially fixed voltage source FVS4 on the non-inverting input terminal of the amplifier 106 during the reset phase, and is configured to allow charge from the switch 116 to be balanced by the switch 117 at the beginning of the generation phase.

A capacitor 103 and a capacitor 104 each have a right terminal that is at least capacitively coupled (e.g., directly coupled as illustrated) to the inverting input terminal of the amplifier 106. A PN junction 105 has a positive terminal that is at least capacitively coupled (e.g., directly coupled as illustrated) to a left terminal of the capacitor 103. The left terminal of the capacitor 104 is configured to be at least capacitively coupled (e.g., directly coupled as illustrated) to the positive terminal of the PN junction 105 during the reset phase and to a negative terminal of the PN junction 105 during the generation phase.

The negative terminal of the PN junction 105 may be coupled to a second substantially fixed voltage source FVS2 which may be a low supply voltage Vss, although the second substantially fixed voltage source FVS2 may be any voltage source that satisfies the definition of a substantially fixed voltage source provided above. The PN junction 105 could be the base emitter region of an NPN or PNP bipolar transistor, or may simply be a PN junction separate and apart from any bipolar transistor. A first current source 101 supplies a first current magnitude through the PN junction 105 during the reset phase. A second current source 102 supplies a second and different current magnitude through the PN junction 105 during the generation phase.

The switched capacitor voltage reference circuit 100 also includes a second feedback path between the output terminal of the amplifier 106 and the inverting input terminal of the amplifier 106. That second feedback path includes a transconductance circuit 113 that has at least one input terminal and at least one output terminal. The input terminal of the transconductance circuit 113 is at least capacitively coupled (in the illustrated example, direct coupled during the generation phase) to the output terminal of the amplifier 106. The output terminal of the transconductance circuit 113 is at least capacitively coupled (in the illustrated example, direct coupled) to an output terminal 114 of the switched capacitor voltage reference circuit 100. The output terminal of the transconductance circuit 113 is capacitively coupled to the substantially fixed voltage source FVS5 via capacitor 118. The transconductance circuit 113 is configured to amplify a current on its output terminal that is dependent upon any voltage change at its input terminal. The transconductance need not be linear.

Also in the second feedback path, a left terminal of a capacitor 107 is at least capacitively coupled (e.g., directly coupled as illustrated) to the inverting terminal of the amplifier 106. The right terminal of a capacitor 107 is at least capacitively coupled (e.g., directly coupled as illustrated) to the output terminal 114 of the switched capacitor regulator circuit 100 during the generation phase, and to the substantially fixed voltage source FVS5 during the reset phase.

The output of the amplifier 106 is potentially provided to a sample and hold circuit that includes a capacitor 115 that capacitively couples the output terminal to the substantially fixed voltage source FVS5. In addition, the output terminal of the amplifier 106 may be optionally selectively coupled to the input terminal of the transconductance circuit 113 during the generation phase to complete the sample and hold circuit.

In this configuration, the change in voltage at the output terminal during the generation phase is defined by the following equation:

$$\Delta e'(t) = \frac{A}{1 + \frac{C_1 + C_2 + C_p}{C_3}}\left(Vout - \frac{C_2}{C_3}\left(V_{BE1} + \frac{C_1}{C_2}U_T * \ln(n)\right)\right) \quad (2)$$

where:

A is the gain of the amplifier 106;

$C_1$ is the capacitance of capacitor 103;

$C_2$ is the capacitance of capacitor 104;

$C_3$ is the capacitance of capacitor 107;

$C_p$ is the parasitic capacitance at the inverting input terminal of the amplifier 106;

Vout is the output voltage at the output terminal 114;

$V_{BE1}$ is the voltage across the PN junction 105 during the reset phase;

$U_T$ is the thermal voltage; and n is the ratio of the magnitude of the current supplied by current supply 101 to the magnitude of the current supplied by current supply 102.

Note that the change in output voltage at the output terminal of the amplifier 106 is not dependent on voltage offset of the amplifier. Accordingly, simple amplifiers including common source transistors can be used for the amplifier 106.

If the gain A of the amplifier 106 is sufficiently large, the feedback will result in the output voltage Vout being defined by the following Equation 3:

$$Vout \approx \frac{C_2}{C_3}\left(V_{BE1} + \frac{C_1}{C_2}U_T * \ln(n)\right) \quad (3)$$

The parameters $V_{BE1}$ and $U_t\ln(n)$ have opposite polarity temperature dependencies. Therefore, by adjusting the capacitor ratio of $C_1/C_2$, it is possible to control the temperature dependencies of the output voltage Vout. In many cases, it is desirable to have a zero temperature coefficient. However, in some applications such as Liquid Crystal Display (LCD) display drivers, it is desirable to have non-zero temperature coefficients. In one embodiment, the capacitor 103 may have only parasitic capacitance thereby minimizing the effect of the temperature dependencies contributed by the term $U_t\ln(n)$. In that case, the temperature dependencies of the output voltage Vout would be approximately the same as the temperature dependency of the voltage $V_{BE1}$. In other applications such as in temperature sensors, it may be desirable to have the capacitor 104 have only parasitic capacitance.

Figure 6:
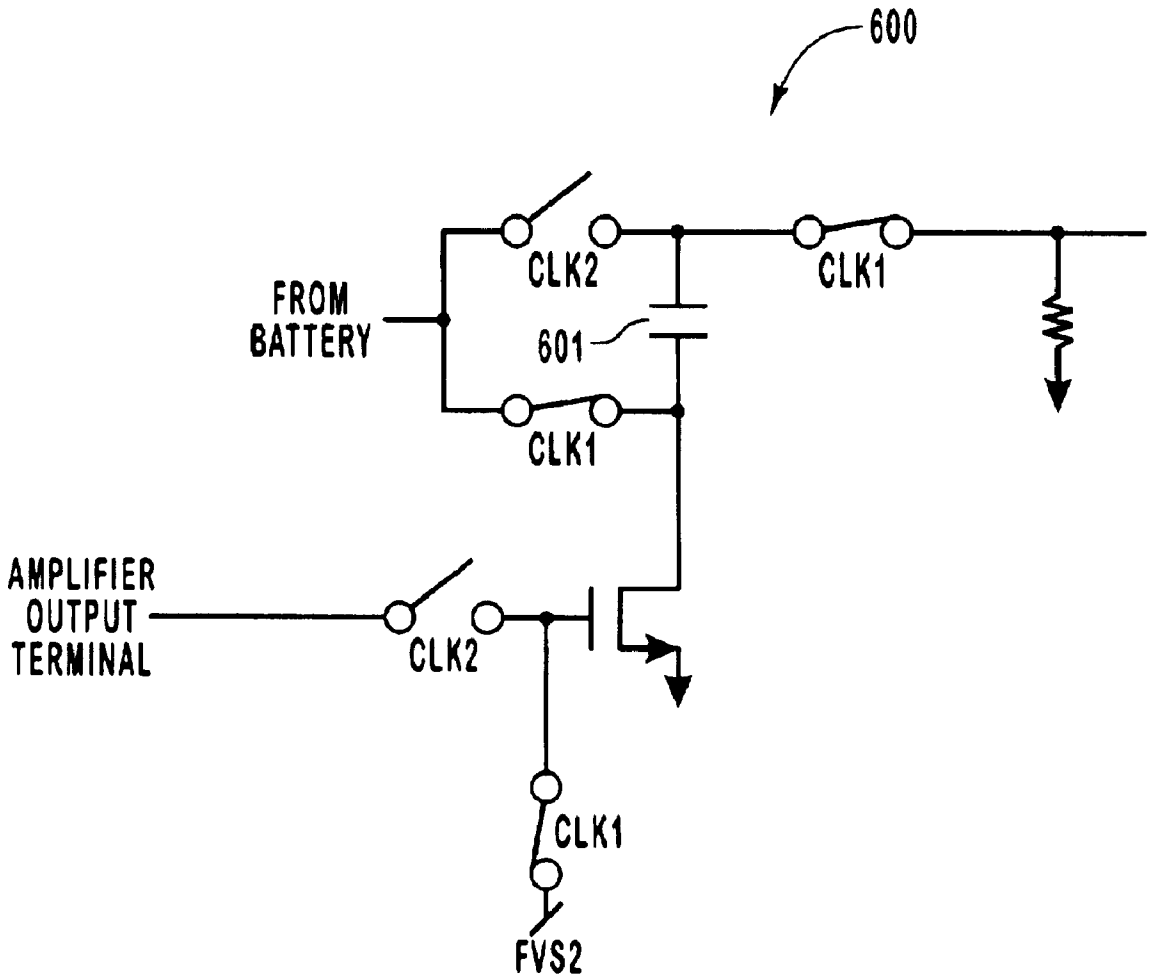
FIG. 6 illustrates a voltage-controlled charge pump that may act as the transconductance circuit of FIGS. 1 through 5.
Figure 7:
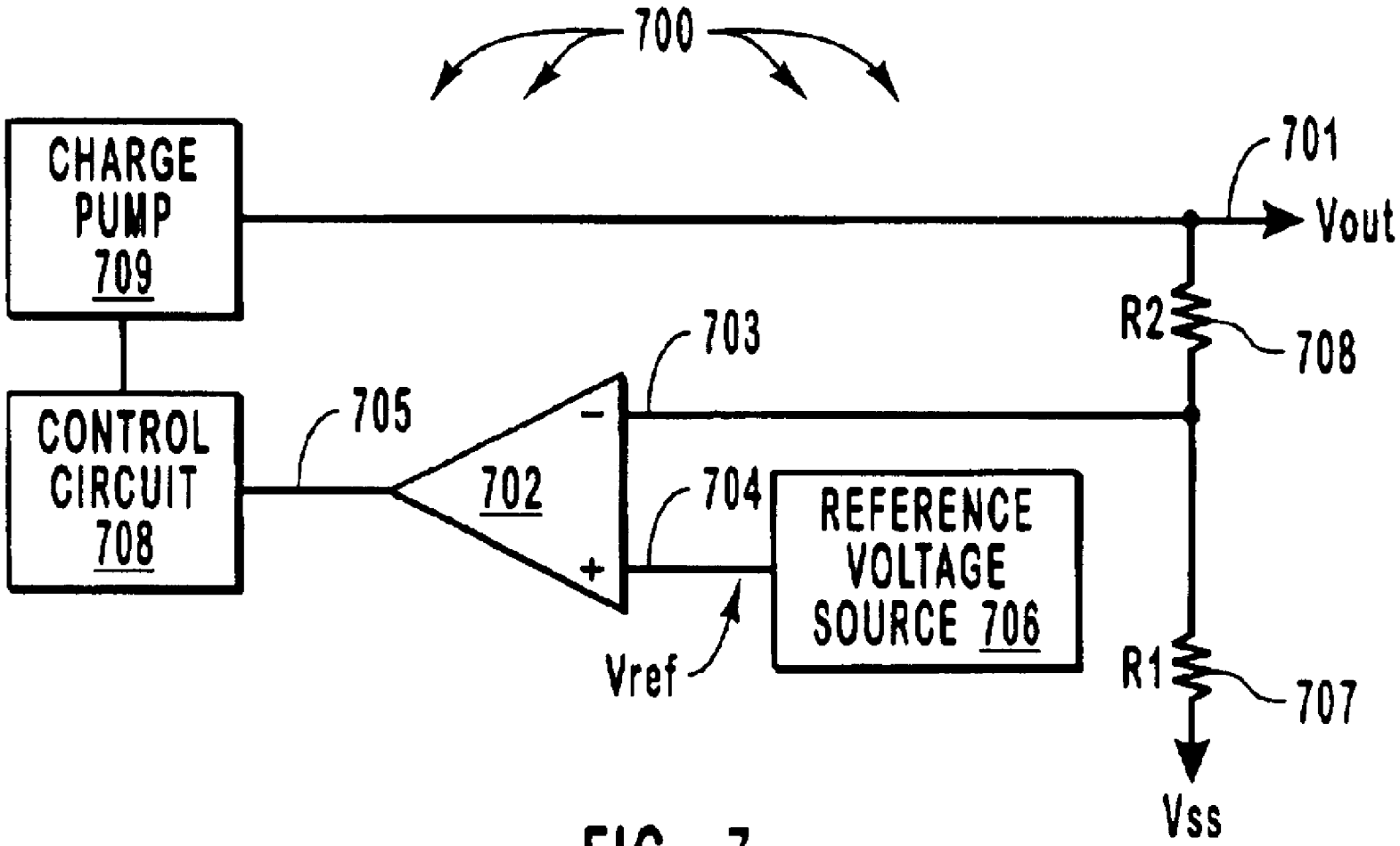
FIG. 7 (PRIOR ART)
FIG. 7 illustrates a enhanced gain, voltage regulator circuit in accordance with the prior art.

Also, the ratio of $C_2/C_3$ may be designed so as to obtain a desired magnitude of Vout. Unlike the conventional switched capacitor voltage reference circuit 800 of FIG. 8, the switched capacitor voltage reference circuit 100 in accordance with the principles of the present invention allow for output voltages that exceed the supply voltage. This may be accomplished by having the transconductance circuit 113 be a charge pump that is controlled in response to the output voltage of the amplifier 106. FIG. 6 illustrates one example of such a charge pump and will be described further below. Accordingly, the principles of the present invention allow for a reference voltage to be generated having desired temperature dependencies and that are not limited to being between the supply voltages available throughout the circuit. The switched capacitor voltage reference circuit also allows the reference voltage to be present on the output terminal at all times, in both the generation and reset phases. Accordingly, circuits that use the reference voltage may count on a stable reference voltage supply, rather than having to account for transience in the reference voltage.

Figure 2:
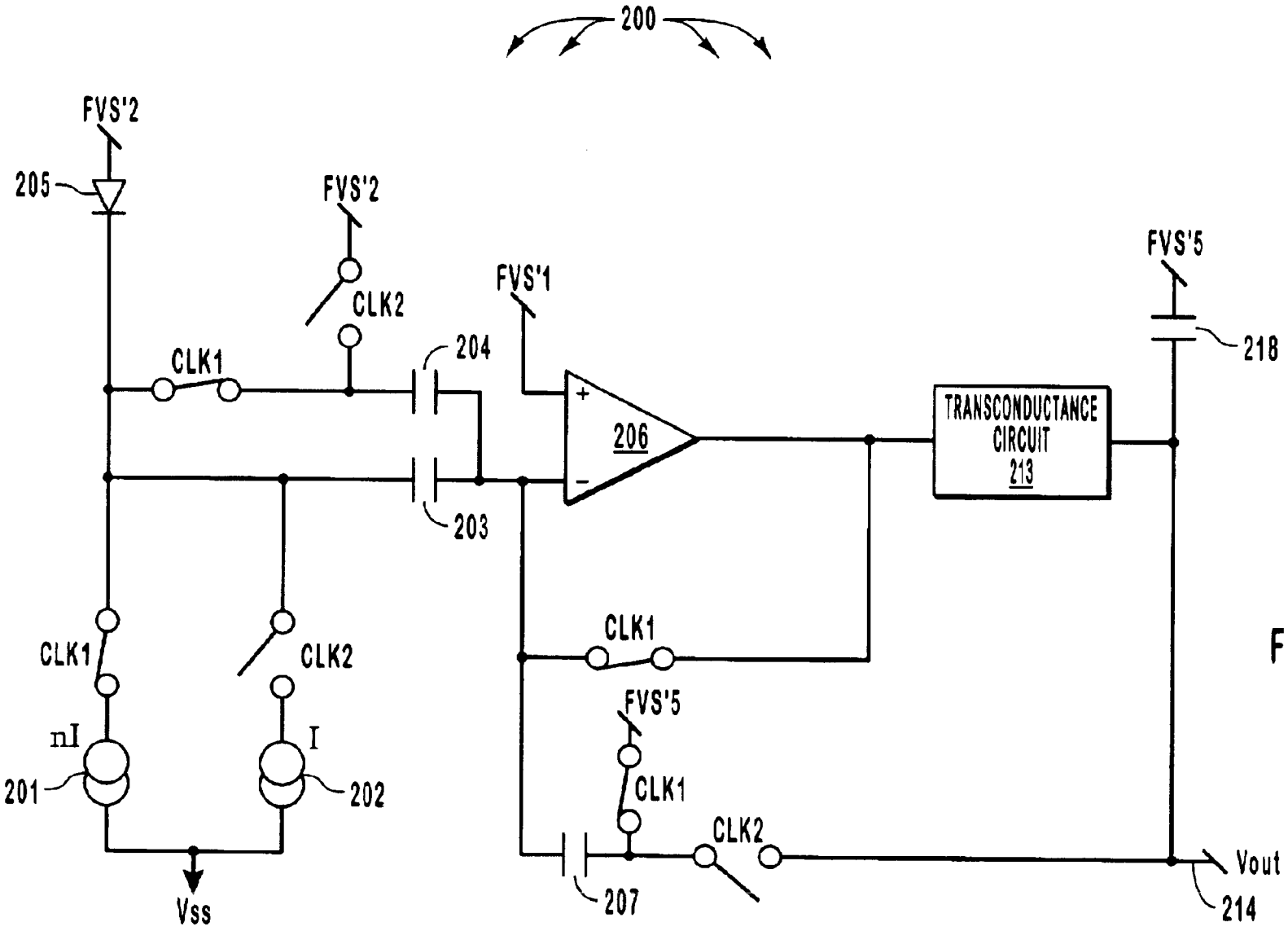
FIG. 2 illustrates a single PN junction switched capacitor voltage reference circuit in accordance with a second embodiment of the present invention in which the PN junction is tied to a high voltage source.

FIG. 2 illustrates a switched capacitor voltage reference circuit 200 that includes many elements that are similar to the switched capacitor voltage reference circuit 100 of FIG. 1, except that that the circuit is illustrated as being vertically inverted, and the positive terminal of the PN junction is coupled to a high substantially fixed voltage source such as Vdd. In addition, the capacitor 204 has a left terminal that is coupled to the negative terminal of the PN junction 205 during the reset phase and to the positive terminal of the PN junction 205 during the generation phase. Also, the optional charge injection reduction circuit 108, the non-return to zero circuit 110, and the sample and hold circuitry (including capacitor 115 and the proximate switch at the output terminal of the amplifier) are not illustrated. High substantially fixed voltage source are replaced by low substantially fixed voltage sources and vice versa. Otherwise, elements 201 through 207 and 213 through 214 and 218 may be similar to their respective elements 101 through 107 and 113 through 114 and 118 of FIG. 1.

Figure 3:
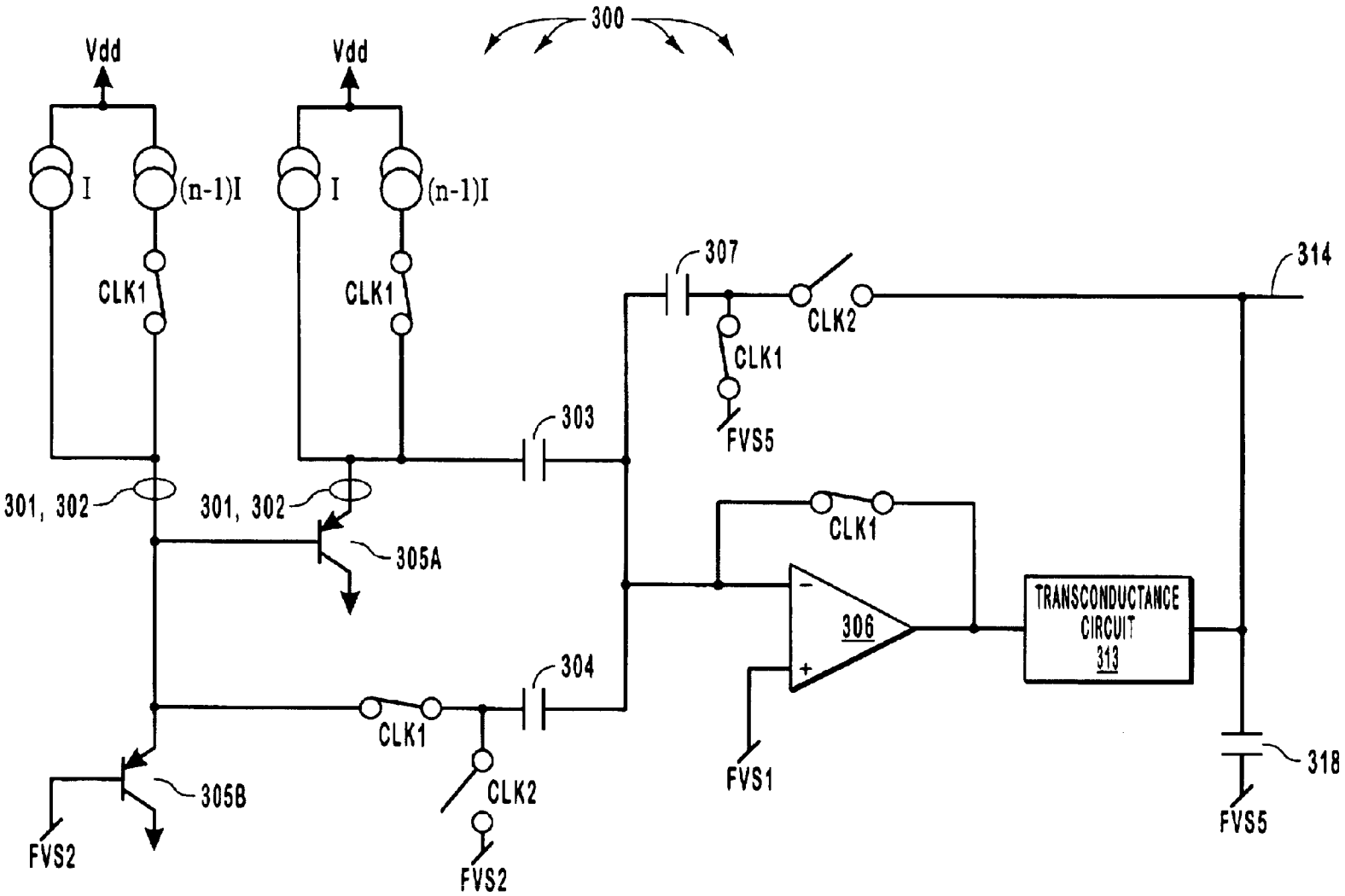
FIG. 3 illustrates a multiple PN junction switched capacitor voltage reference circuit in accordance with a third embodiment of the present invention in which the PN junctions are each a portion of a bipolar transistor and in which the PN junctions are tied to a low voltage source.

FIG. 3 illustrate a switched capacitor voltage reference circuit 300 in accordance with a third embodiment of the present invention in which the current is multiplexed through the base-emitter regions of two bipolar transistors 305A and 305B. This allows the capacitance of the capacitor 303 to be reduced as compared to capacitor 103 of FIG. 1 for a given output voltage. Elements 303, 304, 306, 307, 313, 314 and 318 of FIG. 3 may be similar and are configured similarly as described above for elements 103, 104, 106, 107, 113, 114 and 118 of FIG. 1 (with the exception that capacitor 303 may be made smaller than the capacitor 103).

The switched capacitor voltage reference circuit 300 is configured such that during reset phase, a first current source 301 generating a current of magnitude n times I is passed through the base emitter region of each bipolar transistor. During the generation phase, a second current source 302 generating a current of magnitude I is passed through the base emitter region of each bipolar transistor.

In this case, the two current sources may be simply the circled regions labeled 301 and 302, rather than any current sources that help construct that current. For instance, during the reset phase, current I is added with current (n−1)I to generate current nI at the emitter region of each of the bipolar transistors. In that sense, the leftmost current sources that combine to generate the current nI during the reset phase may be viewed as the current source 301 with respect to the bipolar transistor 305B, while the rightmost current sources that combine to generate the current nI during the reset phase may be viewed as the current source 301 with respect to the bipolar transistor 305A. During the generation phase, the left most of the four current sources, which supplies a current I, may be viewed as the second current source 302 with respect to the bipolar transistor 305B. The second to the right of the four current sources, which supplies a current I, may be viewed as the second current source with respect to the bipolar transistor 305A. Those of ordinary skill in the art will recognize, after having reviewed this description, that a variety of current multiplexing circuits will suffice and still be within the scope of the present invention. The terms "first current source" and "second current source" are intended to be interpreted broadly, with the illustrated examples of current sources being examples only.

Accordingly, the output voltage of the switched capacitor generation circuit would be defined by Equation 4 assuming a large gain.

$$Vout \approx \frac{C_2}{C_3}\left(V_{BE1} + \frac{2C_1}{C_2} U_T * \ln(n)\right) \tag{4}$$

In the illustrated embodiment, there are only two bipolar transistors shown. However, the principles of the present invention may operate with embodiments in which there is a series of more than two bipolar transistors in series configured with the base terminal of a previous bipolar transistor coupled to the emitter terminal of the next bipolar transistor, and with each emitter terminal being supplied by a multiplexed current.

In this more general case, there is a plurality of PN junctions in series, an end PN junction (e.g., the base emitter region of the bipolar transistor 305B) represents the opposite end of the series of PN junctions. The left terminal of the capacitor 304 would be at least capacitively coupled to a positive terminal of at least one of the PN junctions during the reset phase. For example, the left terminal of capacitor 304 is illustrated as being coupled to the positive terminal of the PN junction represented by the emitter terminal of bipolar transistor 305B during the reset phase. It may also be advantageous if the left terminal of capacitor 304 was instead coupled to the positive terminal of the PN junction represented by the emitter terminal of bipolar transistor 305A.

Furthermore, the left terminal of the capacitor 304 would be at least capacitively coupled to a negative terminal of the same PN junction or to a downstream PN junction during a generation phase. For example, the left terminal of capacitor 304 is illustrated as being coupled to the negative terminal of the PN junction represented by the base terminal of bipolar transistor 305B during the generation phase. If the left terminal of the capacitor 304 was coupled to the emitter terminal of the bipolar transistor 305A during the reset phase, then the left terminal of the capacitor 304 may be coupled to the base terminal of bipolar transistor 305A during the generation phase.

Figure 4:
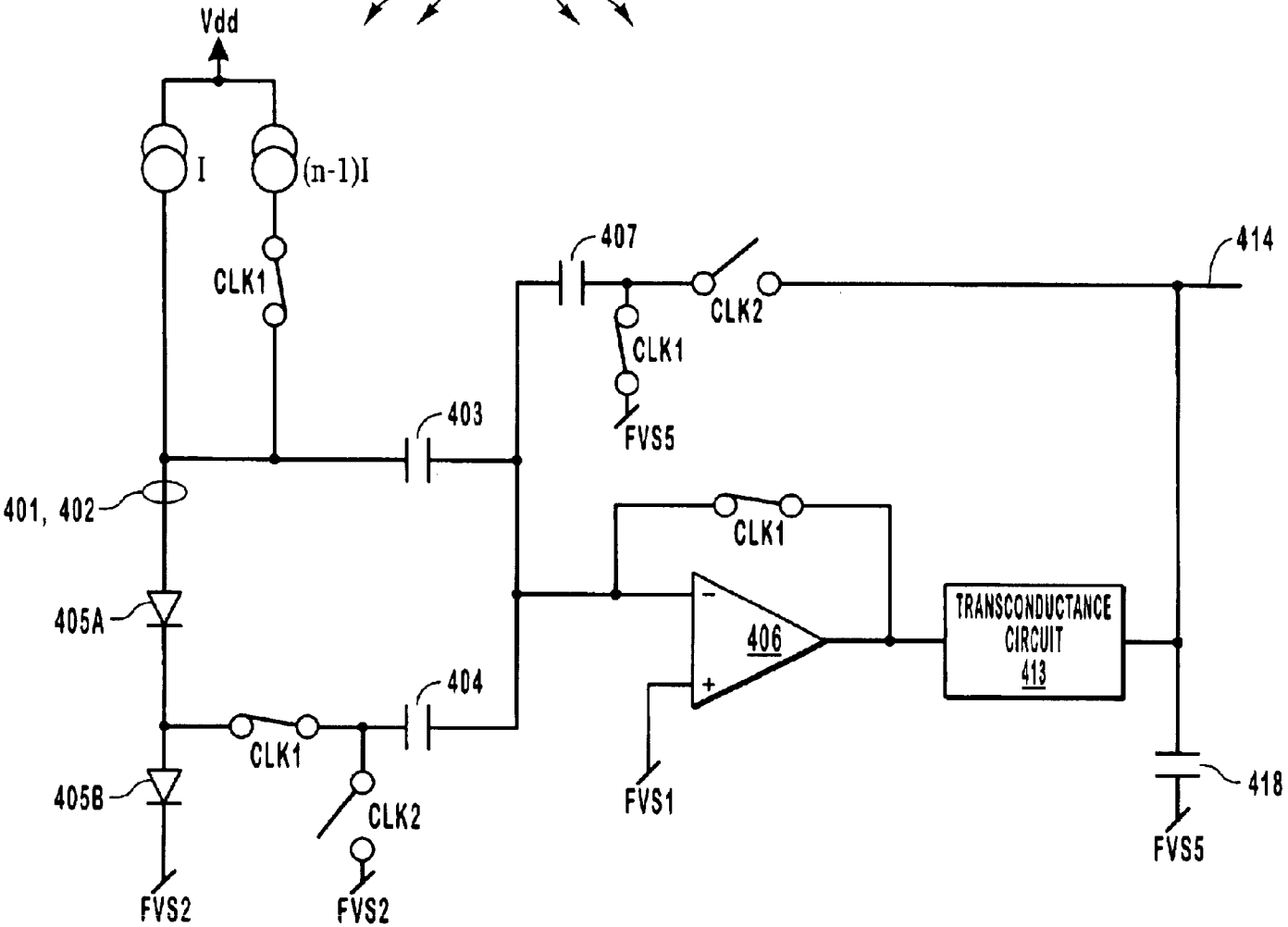
FIG. 4 illustrates a multiple PN junction switched capacitor voltage reference circuit in accordance with a fourth embodiment of the present invention in which the PN junctions are each not a portion of a bipolar transistor and in which the PN junctions are tied to a low voltage source.

FIG. 4 illustrates a switched capacitor voltage reference circuit 400 in accordance with a fourth embodiment of the present invention, and is similar to the switched capacitor generation circuit 300 of FIG. 3, except that the PN junctions 405A and 405B are not part of a bipolar transistor. Once again, the PN junctions are coupled in series with the negative terminal of a previous PN junction in the series coupled to a positive terminal of the next PN junction in the series. In this example, only a single multiplexed current will suffice for all the PN junctions since the current that passes through one will also pass through the other, unlike the case in which the PN junctions are part of a bipolar transistor. The other elements 403, 404, 406, 407, 413, 414 and 418 of FIG. 4 are similar 303, 304, 306, 307, 313, 314 and 318 of FIG. 3.

In one embodiment, there may be a series of PN junctions in which one or more of the PN junctions are the base-emitter region of a bipolar transistors, and one or more other PN junctions in the series are not part of an emitter region.

Figure 5:
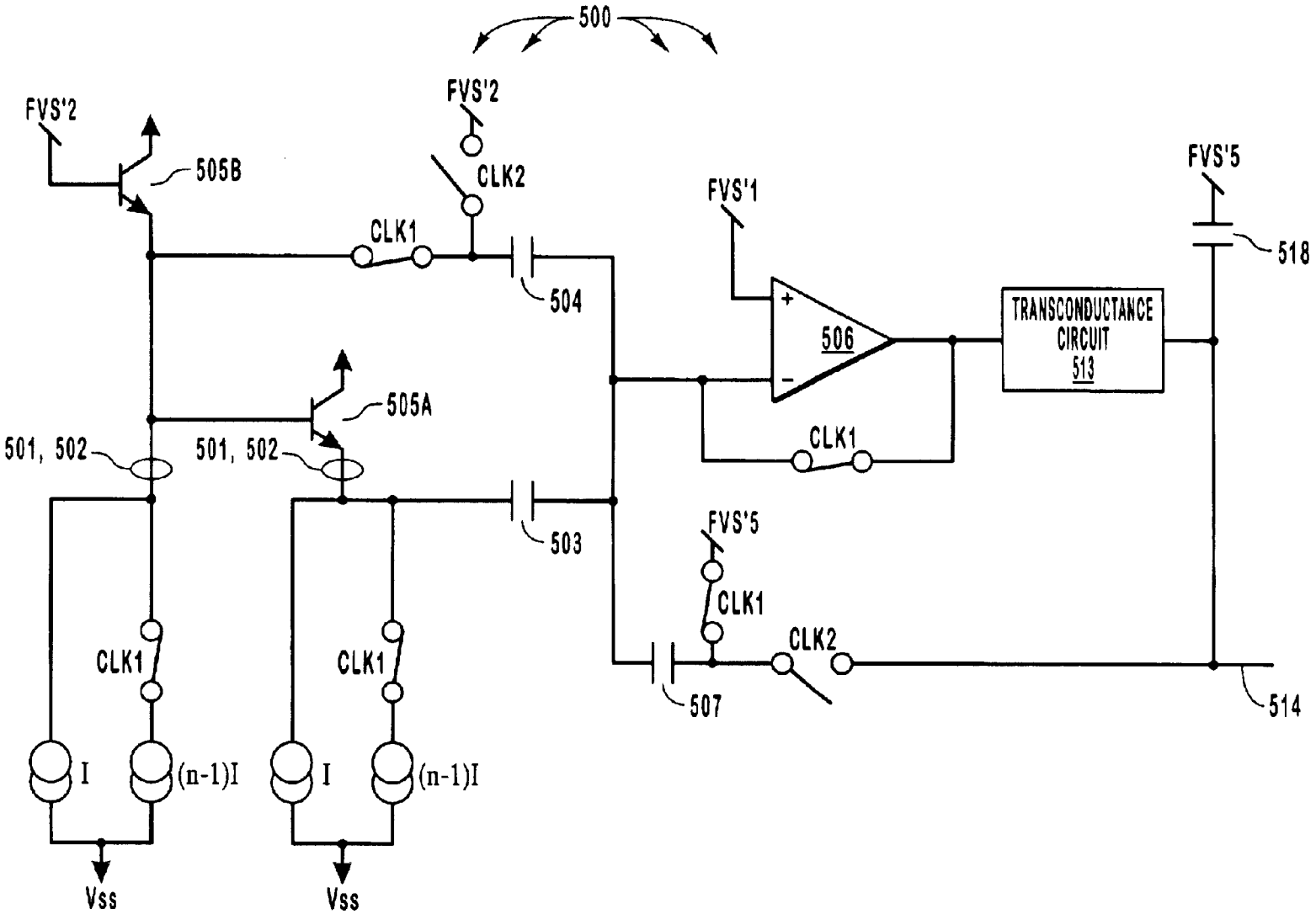
FIG. 5 illustrates a multiple PN junction switched capacitor voltage reference circuit in accordance with a fifth embodiment of the present invention in which the PN junctions are each a portion of a bipolar transistor and in which the PN junctions are tied to a high voltage source.

FIG. 5 illustrates a switched capacitor voltage reference circuit 500 in accordance with a fifth embodiment of the present invention and is similar to the switched capacitor voltage reference circuit 300 of FIG. 3, except that circuit is essentially vertically inverted so high voltage sources are replaced with low voltage sources. Otherwise, elements 501 through 507 and 513 through 514 and 518 of FIG. 5 may be similar to their corresponding components 301 through 307 and 313 through 314 and 318 of FIG. 3. Here, however, the left terminal of the capacitor 504 is configured to be at least capacitively coupled to a negative terminal of at least one of the plurality of PN junctions during the reset phase, and to a positive terminal of the same PN junction or to an upstream PN junction during a second generation phase. In the illustrated example, the left terminal of the capacitor 504 is coupled to the negative terminal of the PN junction inherent in bipolar transistor 505B during the reset phase, while the left terminal of the capacitor 504 is coupled to the positive terminal of that same PN junction during the generation phase.

Accordingly, a number of different embodiments of a switched capacitor voltage reference circuit have been described, each having a transconductance circuit that may be used to generate reference voltages that are not limited to the supply voltages, and which have desired temperature dependencies. FIG. 6 illustrates a transconductance circuit 600 in which the output of the amplifier (e.g., amplifier 106, 206, 306, 406 or 506) is provided to the gate of an NMOS field effect transistor during the generation phase. The output voltage of the amplifier thus controls how much current is drawn from the capacitor 601 during the generation phase. Accordingly, the output of the amplifier controls the charge pump 600 to thereby control the voltage at the output terminal of the charge pump. The operation of such voltage-controlled charge pumps are known to those of ordinary skill in the art.

Accordingly, switched charge voltage reference circuits that provide predictable temperature dependencies and are not limited to supply voltage have been described. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes, which come within the meaning and range of equivalency of the claims, are to be embraced within their scope.

What is claimed and desired secured by United States Letters Patent is:

1. A switched capacitor voltage reference circuit that operates on a cycle that includes a reset phase and a generation phase to generate an output voltage on an output terminal that is relatively predictable with temperature variations, the switched capacitor voltage reference circuit comprising the following:

an amplifier having inverting and non-inverting input terminals and at least one output terminal, the output terminal configured to be at least capacitively coupled to the inverting input terminal during the reset phase to define a first feedback loop;

a first capacitor having a first and second terminal, the first terminal of the first capacitor at least capacitively coupled to the inverting input terminal of the amplifier, the non-inverting terminal of the amplifier coupled to a first substantially fixed voltage source;

a second capacitor having a first and second terminal, the first terminal of the second capacitor at least capacitively coupled to the inverting input terminal of the amplifier;

a PN junction having a first terminal that is at least capacitively coupled to a second terminal of the first capacitor, a second terminal of the PN junction being coupled to a second substantially fixed voltage source, the second terminal of the second capacitor being configured to be at least capacitively coupled to the first terminal of the PN junction during the reset phase and to the second terminal of the PN junction during the generation phase;

a first current source that is configured to supply a first current magnitude through the PN junction during the first time period;

a second current source that is configured to supply a second current magnitude through the PN junction during the second time period, the second current magnitude being different than the first current magnitude;

a transconductance circuit that has at least one input terminal and at least one output terminal, the input terminal of the transconductance circuit being at least capacitively coupled to the output terminal of the amplifier, the output terminal of the transconductance circuit being at least capacitively coupled to an output terminal of the switched capacitor voltage regulator circuit, the transconductance circuit being configured to generate a current change that is approximately proportional to a change in voltage at the input terminal of the transconductance circuit; and a third capacitor having a first and second terminal, the first terminal of the third capacitor at least capacitively coupled to the inverting input terminal of the amplifier, the second terminal of the capacitor at least capacitively coupled to the output terminal of the switched capacitor voltage reference circuit during the generation phase, and to a third substantially fixed voltage source during the reset phase.

2. A switched capacitor voltage reference circuit in accordance with claim 1, wherein the first terminal of the PN junction is a positive terminal of the PN junction, and wherein the second terminal of the PN junction is a negative terminal of the PN junction.

3. A switched capacitor voltage reference circuit in accordance with claim 1, wherein the first terminal of the PN junction is a negative terminal of the PN junction, and wherein the second terminal of the PN junction is a positive terminal of the PN junction.

4. A switched capacitor voltage reference circuit in accordance with claim 1, wherein a capacitance of the first capacitor is minimized so as to include only parasitic capacitance.

5. A switched capacitor regulator circuit in accordance with claim 1, wherein a capacitance of the first capacitor is not minimized so as to include more than parasitic capacitance.

6. A switched capacitor voltage reference circuit in accordance with claim 1, wherein a capacitance of the second capacitor is minimized so as to include only parasitic capacitance.

7. A switched capacitor regulator circuit in accordance with claim 1, wherein a capacitance of the second capacitor is not minimized so as to include more than parasitic capacitance.

8. A switched capacitor regulator circuit in accordance with claim 1, wherein the PN junction is not a portion of a bipolar transistor.

9. A switched capacitor regulator circuit in accordance with claim 1, wherein the PN junction is a portion of a bipolar transistor.

10. A switched capacitor regulator circuit in accordance with claim 1, wherein the output terminal of the amplifier is coupled to the inverting input terminal during the reset phase.

11. A switched capacitor regulator circuit in accordance with claim 1, wherein the output terminal of the amplifier is capacitively coupled to the inverting input terminal during the reset phase.

12. A switched capacitor regulator circuit in accordance with claim 1, wherein the first feedback loop comprises the following:

a fourth capacitor having first and second terminals, a first terminal of the fourth capacitor coupled to the output terminal of the amplifier, the second terminal of the fourth capacitor being configured to be coupled to the inverting input terminal of the amplifier during the reset phase and to a fourth substantially fixed voltage source during the generation phase.

13. A switched capacitor regulator circuit in accordance with claim 12, further comprising:

a charge injection reduction circuit that includes a fifth capacitor capacitively coupling the non-inverting input terminal of the amplifier to a fifth substantially fixed voltage source, and that is configured to apply the fourth substantially fixed voltage source on the non-inverting input terminal of the amplifier during the reset phase.

14. A switched capacitor regulator circuit in accordance with claim 1, further comprising:

a charge injection reduction circuit that includes a fourth capacitor capacitively coupling the non-inverting input terminal of the amplifier to a fourth substantially fixed voltage source, and that is configured to apply a fifth substantially fixed voltage source on the non-inverting input terminal of the amplifier during the reset phase.

15. A switched capacitor regulator circuit in accordance with claim 1, further comprising:

a fourth capacitor having a first terminal coupled to the output terminal of the amplifier during the generation phase and coupled to the input terminal of the transconductance circuit, and a second terminal coupled to the third substantially fixed voltage source.

16. A switched capacitor regulator circuit in accordance with claim 1, wherein the transconductance circuit comprises a charge pump.

17. A switched capacitor voltage reference circuit that operates on a cycle that includes a reset phase and a generation phase to generate an output voltage on an output terminal that is relatively predictable with temperature variations, the switched capacitor voltage reference circuit comprising the following:

an amplifier having inverting and non-inverting input terminals and at least one output terminal, the output terminal configured to be at least capacitively coupled to the inverting input terminal during the reset phase to define a first feedback loop;

a first capacitor having a first and second terminal, the first terminal of the first capacitor at least capacitively coupled to the inverting input terminal of the amplifier, the non-inverting terminal of the amplifier coupled to a first substantially fixed voltage source;

a second capacitor having a first and second terminal, the first terminal of the second capacitor at least capacitively coupled to the inverting input terminal of the amplifier;

a series of a plurality of PN junctions having a start PN junction at least capacitively coupled to the second terminal of the first capacitor, the plurality of PN junctions including an end PN junction that represents the opposite end of the series of the plurality of PN junctions as compared to the start PN junction, a negative terminal of the end PN junction being coupled to a second substantially fixed voltage source, the second terminal of the second capacitor being configured to be at least capacitively coupled to a positive terminal of at least one of the plurality of PN junctions during the reset phase and to a negative terminal of the same PN junction or to a downstream PN junction during the generation phase;

a first current source that is configured to supply a first current magnitude through the plurality of PN junctions during the reset phase;

a second current source that is configured to supply a second current magnitude through the plurality of PN junctions during the generation phase, the second current magnitude being different than the first current magnitude;

a transconductance circuit that has at least one input terminal and at least one output terminal, the input terminal of the transconductance circuit being at least capacitively coupled to the output terminal of the amplifier, the output terminal of the transconductance circuit being at least capacitively coupled to an output terminal of the switched capacitor voltage regulator circuit, the transconductance circuit being configured to generate a current change that is approximately proportional to a change in voltage at the input terminal of the transconductance circuit; and a third capacitor having a first and second terminal, the first terminal of the third capacitor at least capacitively coupled to the inverting input terminal of the amplifier, the second terminal of the capacitor at least capacitively coupled to the output terminal of the switched capacitor voltage reference circuit during the generation phase, and to a third substantially fixed voltage source during the reset phase.

18. A switched capacitor voltage reference circuit in accordance with claim 17, wherein the first current source is a single current source that is configured to supply the first current magnitude through all of the plurality of PN junctions during the first time period, wherein the second current source is a single current source that is configured to supply the second current magnitude though all of the plurality of PN junctions.

19. A switched capacitor voltage reference circuit in accordance with claim 17, wherein all of the PN junction in the series of the plurality of PN junctions are a portion of a bipolar transistor, wherein the first current source is a plurality of current sources, each configured to supply the first current magnitude to the base-emitter region of the corresponding bipolar transistor, and wherein the second current source is a plurality of current sources, each configured to supply the second current magnitude to the base-emitter region of the corresponding bipolar transistor.

20. A switched capacitor voltage reference circuit in accordance with claim 17, wherein the plurality of PN junctions are each part of a bipolar transistor.

21. A switched capacitor voltage reference circuit in accordance with claim 17, wherein the first feedback loop comprises the following:

a fourth capacitor having first and second terminals, a first terminal of the fourth capacitor coupled to the output terminal of the amplifier, the second terminal of the fourth capacitor being configured to be coupled to the inverting input terminal of the amplifier during the reset phase and to a fourth substantially fixed voltage source during the generation phase.

22. A switched capacitor voltage reference circuit in accordance with claim 21, further comprising:

a charge injection reduction circuit that includes a fifth capacitor capacitively coupling the non-inverting input terminal of the amplifier to a fifth substantially fixed voltage source, and that is configured to apply the fourth substantially fixed voltage source on the non-inverting input terminal of the amplifier during the reset phase.

23. A switched capacitor voltage reference circuit in accordance with claim 17, further comprising:

a charge injection reduction circuit that includes a fourth capacitor capacitively coupling the non-inverting input terminal of the amplifier to a fourth substantially fixed voltage source, and that is configured to apply a fifth substantially fixed voltage source on the non-inverting input terminal of the amplifier during the reset phase.

24. A switched capacitor voltage reference circuit in accordance with claim 17, further comprising:

a fourth capacitor having a first terminal coupled to the output terminal of the amplifier during the generation phase and coupled to the input terminal of the transconductance circuit, and a second terminal coupled to the third substantially fixed voltage source.

25. A switched capacitor voltage reference circuit in accordance with claim 17, wherein the transconductance circuit comprises a charge pump.

26. A switched capacitor voltage reference circuit in accordance with claim 17, wherein the plurality of PN junctions comprise two PN junctions.

27. A switched capacitor regulator circuit in accordance with claim 26, wherein the second terminal of the second capacitor is configured to be at least capacitively coupled to a positive terminal of the end PN junction during the reset phase and to a negative terminal of the end PN junction during the generation phase.

28. A switched capacitor voltage reference circuit in accordance with claim 17, wherein the second terminal of the second capacitor is configured to be at least capacitively coupled to a positive terminal of the end PN junction during the reset phase and to a negative terminal of the end PN junction during the generation phase.

29. A switched capacitor regulator circuit in accordance with claim 26, wherein the second terminal of the second capacitor is configured to be at least capacitively coupled to a positive terminal of the start PN junction during the reset phase and to a negative terminal of the start PN junction during the generation phase.

30. A switched capacitor voltage reference circuit in accordance with claim 17, wherein the second terminal of the second capacitor is configured to be at least capacitively coupled to a positive terminal of the start PN junction during the reset phase and to a negative terminal of the start PN junction during the generation phase.

31. A switched capacitor voltage reference circuit that operates on a cycle that includes a reset phase and a generation phase to generate an output voltage on an output terminal that is relatively predictable with temperature variations, the switched capacitor reference circuit comprising the following:

an amplifier having inverting and non-inverting input terminals and at least one output terminal, the output terminal configured to be at least capacitively coupled to the inverting input terminal during the reset phase to define a first feedback loop;

a first capacitor having a first and second terminal, the first terminal of the first capacitor at least capacitively coupled to the inverting input terminal of the amplifier, the non-inverting terminal of the amplifier coupled to a first substantially fixed voltage source;

a second capacitor having a first and second terminal, the first terminal of the second capacitor at least capacitively coupled to the inverting input terminal of the amplifier;

a series of a plurality of PN junctions having a start PN junction at least capacitively coupled to the second terminal of the first capacitor, the plurality of PN junctions including an end PN junction that represents the opposite end of the series of the plurality of PN junctions as compared to the start PN junction, a positive terminal of the end PN junction being coupled to a second substantially fixed voltage source, the second terminal of the second capacitor being configured to be at least capacitively coupled to a negative terminal of at least one of the plurality of PN junctions during the reset phase and to a positive terminal of the same PN junction or to an upstream PN junction during a generation phase;

a first current source that is configured to supply a first current magnitude through the plurality of PN junctions during the reset phase;

a second current source that is configured to supply a second current magnitude through the plurality of PN junctions during the generation phase, the second current magnitude being different than the first current magnitude;

a transconductance circuit that has at least one input terminal and at least one output terminal, the input terminal of the transconductance circuit being at least capacitively coupled to the output terminal of the amplifier, the output terminal of the transconductance circuit being at least capacitively coupled to an output terminal of the switched capacitor voltage regulator circuit, the transconductance circuit being configured to generate a current change that is approximately proportional to a change in voltage at the input terminal of the transconductance circuit; and a third capacitor having a first and second terminal, the first terminal of the third capacitor at least capacitively coupled to the inverting input terminal of the amplifier, the second terminal of the capacitor at least capacitively coupled to the output terminal of the switched capacitor voltage reference circuit during the generation phase, and to a third substantially fixed voltage source during the reset phase.

32. A switched capacitor regulator circuit in accordance with claim 31, wherein the first feedback loop comprises the following:

a fourth capacitor having first and second terminals, a first terminal of the fourth capacitor coupled to the output terminal of the amplifier, the second terminal of the fourth capacitor being configured to be coupled to the inverting input terminal of the amplifier during the reset phase and to a fourth substantially fixed voltage source during the second time period.

33. A switched capacitor regulator circuit in accordance with claim 32, further comprising:

a charge injection reduction circuit that includes a fifth capacitor capacitively coupling the non-inverting input terminal of the amplifier to a fifth substantially fixed voltage source, and that is configured to apply the fourth substantially fixed voltage source on the non-inverting input terminal of the amplifier during the reset phase.

34. A switched capacitor regulator circuit in accordance with claim 31, further comprising:

a charge injection reduction circuit that includes a fourth capacitor capacitively coupling the non-inverting input terminal of the amplifier to a fourth substantially fixed voltage source, and that is configured to apply a fifth substantially fixed voltage source on the non-inverting input terminal of the amplifier during the reset phase.

35. A switched capacitor regulator circuit in accordance with claim 31, wherein the transconductance circuit comprises a charge pump.

36. A switched capacitor regulator circuit in accordance with claim 31, wherein the plurality of PN junctions comprise two PN junctions.

37. A switched capacitor regulator circuit in accordance with claim 36, wherein the second terminal of the second capacitor is configured to be at least capacitively coupled to a negative terminal of the end PN junction during the reset phase and to a positive terminal of the end PN junction during the generation phase.

38. A switched capacitor regulator circuit in accordance with claim 31, wherein the second terminal of the second capacitor is configured to be at least capacitively coupled to a negative terminal of the end PN junction during the reset phase and to a positive terminal of the end PN junction during the generation phase.

39. A switched capacitor regulator circuit in accordance with claim 36, wherein the second terminal of the second capacitor is configured to be at least capacitively coupled to a negative terminal of the start PN junction during the reset phase and to a positive terminal of the start PN junction during the generation phase.

40. A switched capacitor regulator circuit in accordance with claim 31, wherein the second terminal of the second capacitor is configured to be at least capacitively coupled to a negative terminal of the start PN junction during the reset phase and to a positive terminal of the start PN junction during the generation phase.

* * * * *

UNITED STATES PATENT AND TRADEMARK OFFICE

CERTIFICATE OF CORRECTION

PATENT NO. : 6,819,163 B1
DATED : November 16, 2004
INVENTOR(S) : Bernard Robert Gregoire, Jr.

It is certified that error appears in the above-identified patent and that said Letters Patent is hereby corrected as shown below:

Title page,
Item [*], Notice, change “18 days.” to -- 67 days. --

Column 3,
Line 67, change “Once example” to -- One example --

Column 5,
Line 33, before “substantially the same” remove “a”
Line 59, before “reset phase” insert -- a --

Column 8,
Line 5, after “depend on” insert -- the --
Line 66, after “fixed voltage” change “source” to -- sources --

Column 9,
Line 4, after “FIG. 3” change “illustrate” to -- illustrates --

Column 10,
Line 42, after “except that” insert -- the --

Signed and Sealed this

Seventeenth Day of May, 2005

JON W. DUDAS
*Director of the United States Patent and Trademark Office*